US009134669B2

(12) United States Patent
Suzuki

(10) Patent No.: US 9,134,669 B2
(45) Date of Patent: Sep. 15, 2015

(54) IMAGE FORMING APPARATUS HAVING EXPOSURE OPERATION CONTROL

(71) Applicant: Takashi Suzuki, Aichi (JP)

(72) Inventor: Takashi Suzuki, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 111 days.

(21) Appl. No.: 13/956,914

(22) Filed: Aug. 1, 2013

(65) Prior Publication Data

US 2014/0086602 A1 Mar. 27, 2014

(30) Foreign Application Priority Data

Sep. 26, 2012 (JP) ..... 2012-212317

(51) Int. Cl.
*G03G 15/00* (2006.01)
*G03G 15/043* (2006.01)

(52) U.S. Cl.
CPC ..... *G03G 15/505* (2013.01); *G03G 15/043* (2013.01); *G03G 15/5008* (2013.01); *G03G 15/6564* (2013.01); *G03G 2215/00721* (2013.01)

(58) Field of Classification Search
CPC ..... G03G 15/505; G03G 15/5008; G03G 15/6564; G03G 15/043; G03G 2215/00599; G03G 2215/00721; G03G 2215/00603
See application file for complete search history.

(56) References Cited

U.S. PATENT DOCUMENTS 4,129,377 A * 12/1978 Miyamoto et al. ..... 399/195
4,248,523 A * 2/1981 Doi et al. ..... 399/387
4,613,227 A * 9/1986 Honjo ..... 399/76
4,690,545 A * 9/1987 Maehara ..... 355/51
4,714,941 A * 12/1987 Yamagishi et al. ..... 399/86
4,893,150 A * 1/1990 Yamada ..... 399/11
5,043,771 A * 8/1991 Shibata et al. ..... 399/396
5,073,802 A * 12/1991 Sugiyama ..... 399/85
5,323,219 A * 6/1994 Hamanaka et al. ..... 399/371
5,444,830 A * 8/1995 Oh et al. ..... 358/1.9
5,450,170 A * 9/1995 Kimizuka et al. ..... 399/18
5,528,350 A * 6/1996 Tanaka et al. ..... 399/45
5,642,145 A * 6/1997 Tanaka et al. ..... 347/111
5,678,127 A * 10/1997 Suga ..... 399/45
7,756,463 B2 * 7/2010 Takahashi ..... 399/388

(Continued)

FOREIGN PATENT DOCUMENTS

JP 5-323703 A 12/1993
JP 7-121065 A 5/1995
JP 9-269715 A 10/1997
JP H10-31394 A 2/1998

(Continued)

*Primary Examiner* — G. M. Hyder
(74) *Attorney, Agent, or Firm* — Scully, Scott, Murphy & Presser P.C.

(57) ABSTRACT

An image forming apparatus is provided that includes a controller configured to perform an acquiring operation of acquiring an exposure completion time point when an exposure operation of exposing a photoconductive body using image data has been completed and a trailing-end detecting time point when a detector has detected a trailing end of a sheet, and a determining operation of determining whether a developer image would be transferred outside the sheet, based on the exposure completion time point and the trailing-end detecting time point acquired in the acquiring operation, a transfer time period required for an arbitrary point on the photoconductive body to move to a transfer position from an exposure position, and a conveyance time period required for a trailing end of the sheet to move to the transfer position since the detector detects the trailing end of the sheet.

13 Claims, 13 Drawing Sheets

(56) References Cited

U.S. PATENT DOCUMENTS

| | | | | |
|---|---|---|---|---|
| 2005/0254870 | A1* | 11/2005 | Takahashi | 399/388 |
| 2007/0140715 | A1* | 6/2007 | Choi | 399/53 |

FOREIGN PATENT DOCUMENTS

| | | | |
|---|---|---|---|
| JP | 2001-228778 | A | 8/2001 |
| JP | 2007-069533 | A | 3/2007 |

* cited by examiner

IMAGE FORMING APPARATUS HAVING EXPOSURE OPERATION CONTROL

CROSS-REFERENCE TO RELATED APPLICATION

This application claims priority under 35 U.S.C. §119 from Japanese Patent Application No. 2012-212317 filed on Sep. 26, 2012. The entire subject matter of the application is incorporated herein by reference.

BACKGROUND

1. Technical Field

The following description relates to one or more techniques for determining whether a developer image would be transferred outside a sheet.

2. Related Art

A technique has been known for terminating an exposure operation of exposing a photoconductive body in response to a sheet sensor detecting a trailing end of a sheet.

SUMMARY

In recent years, with the progress in downsizing an image forming apparatus, a conveyance path for conveying a sheet thereon becomes shorter, and therefore a distance between a sheet sensor for detecting the sheet and a transfer position where a developer image is transferred onto the sheet becomes shorter. Under such circumstances, in the case where the exposure operation of exposing the photoconductive body is terminated at a moment when the sheet sensor detects a trailing end of the sheet, it might cause a problem that the developer image is partially transferred outside the sheet.

Aspects of the present invention are advantageous to provide one or more improved techniques to determine whether a developer image would be transferred outside a sheet, in order to prevent the above problem.

According to aspects of the present invention, an image forming apparatus is provided that includes a photoconductive body, an exposure unit configured to perform, for an exposure position on the photoconductive body, an exposure operation of exposing the photoconductive body using image data and forming on the photoconductive body an electrostatic latent image based on the image data, a development unit configured to develop with development agent the electrostatic latent image formed on the photoconductive body and form a developer image on the photoconductive body, a transfer unit configured to transfer the developer image from the photoconductive body onto the sheet, in a transfer position where the transfer unit faces the photoconductive body across the sheet, a feeding unit configured to feed the sheet in a conveyance direction on a conveyance path, toward the transfer position, a detector configured to detect the sheet on the conveyance path and disposed in a predetermined position on the conveyance path, the predetermined position being such a position that a conveyance time period required for a trailing end of the sheet to move to the transfer position since the detector detects the trailing end of the sheet is shorter than a transfer time period required for an arbitrary point on the photoconductive body to move from the exposure position for exposing the photoconductive body to the transfer position for transferring the developer image onto the sheet, and a controller configured to perform an acquiring operation of acquiring an exposure completion time point when the exposure operation using the image data has been completed and a trailing-end detecting time point when the detector has detected the trailing end of the sheet, and a determining operation of determining whether the developer image would be transferred outside the sheet, based on the exposure completion time point and the trailing-end detecting time point acquired in the acquiring operation, the transfer time period, and the conveyance time period.

According to aspects of the present invention, further provided is an image forming apparatus configured to electrophotographically form an image on a sheet, the image forming apparatus including a photoconductive body, an exposure unit configured to perform, for an exposure position on the photoconductive body, an exposure operation of exposing the photoconductive body and forming an electrostatic latent image on the photoconductive body, a development unit configured to develop with development agent the electrostatic latent image formed on the photoconductive body and form a developer image on the photoconductive body, a transfer unit configured to transfer the developer image from the photoconductive body onto the sheet, in a transfer position where the transfer unit faces the photoconductive body across the sheet, a conveyance mechanism configured to convey the sheet in a conveyance direction via the transfer position on a conveyance path, the conveyance mechanism including a first detector configured to output a first signal when the sheet is in a first position on the conveyance path, and output a second signal when the sheet is not in the first position on the conveyance path, a second detector configured to output a first-state signal when the sheet is in a second position upstream relative to the first position in the conveyance direction on the conveyance path, and output a second-state signal when the sheet is not in the second position on the conveyance path, and a feeding roller disposed between the first detector and the second detector on the conveyance path and configured to feed the sheet in the conveyance direction from the second detector toward the first detector, and a controller configured to control the exposure unit to start the exposure operation in response to the second signal output from the first detector changing into the first signal, and control the exposure unit to terminate the exposure operation in response to the first-state signal output from the second detector changing into the second-state signal.

BRIEF DESCRIPTION OF THE ACCOMPANYING DRAWINGS

Figure 4A:
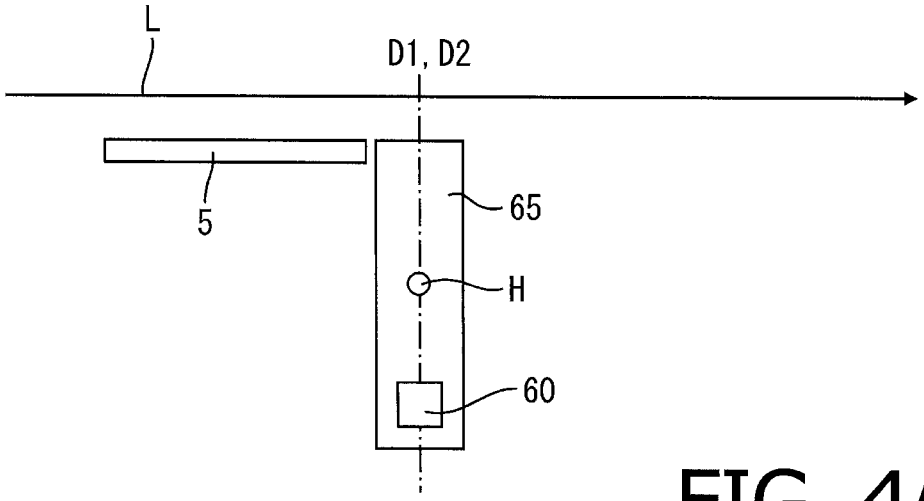

FIG. 4A schematically shows a state where the first detector or the second detector does not detect a sheet in the first embodiment according to one or more aspects of the present invention.

Figure 4B:
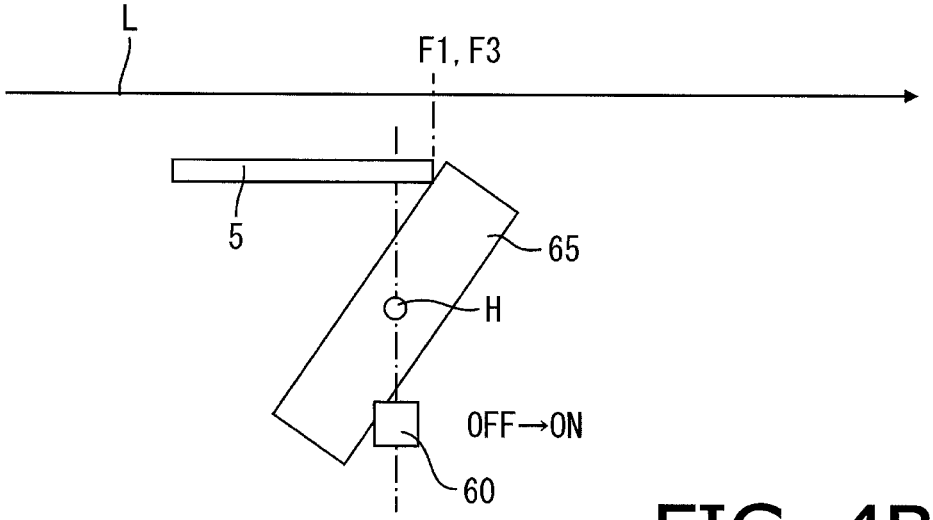

FIG. 4B schematically shows a state where the first detector or the second detector detects a leading end of the sheet in the first embodiment according to one or more aspects of the present invention.

Figure 4C:
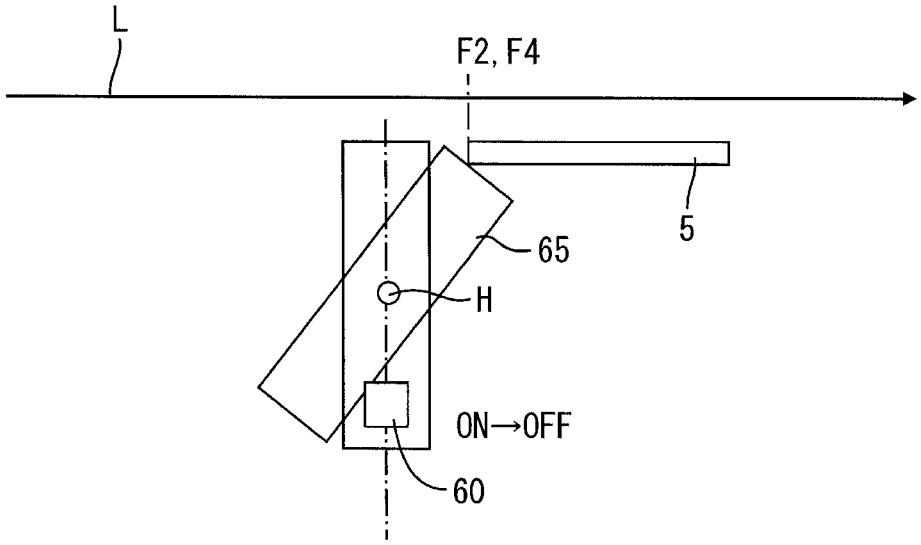

FIG. 4C schematically shows a state where the first detector or the second detector detects a trailing end of the sheet in the first embodiment according to one or more aspects of the present invention.

Figure 5:
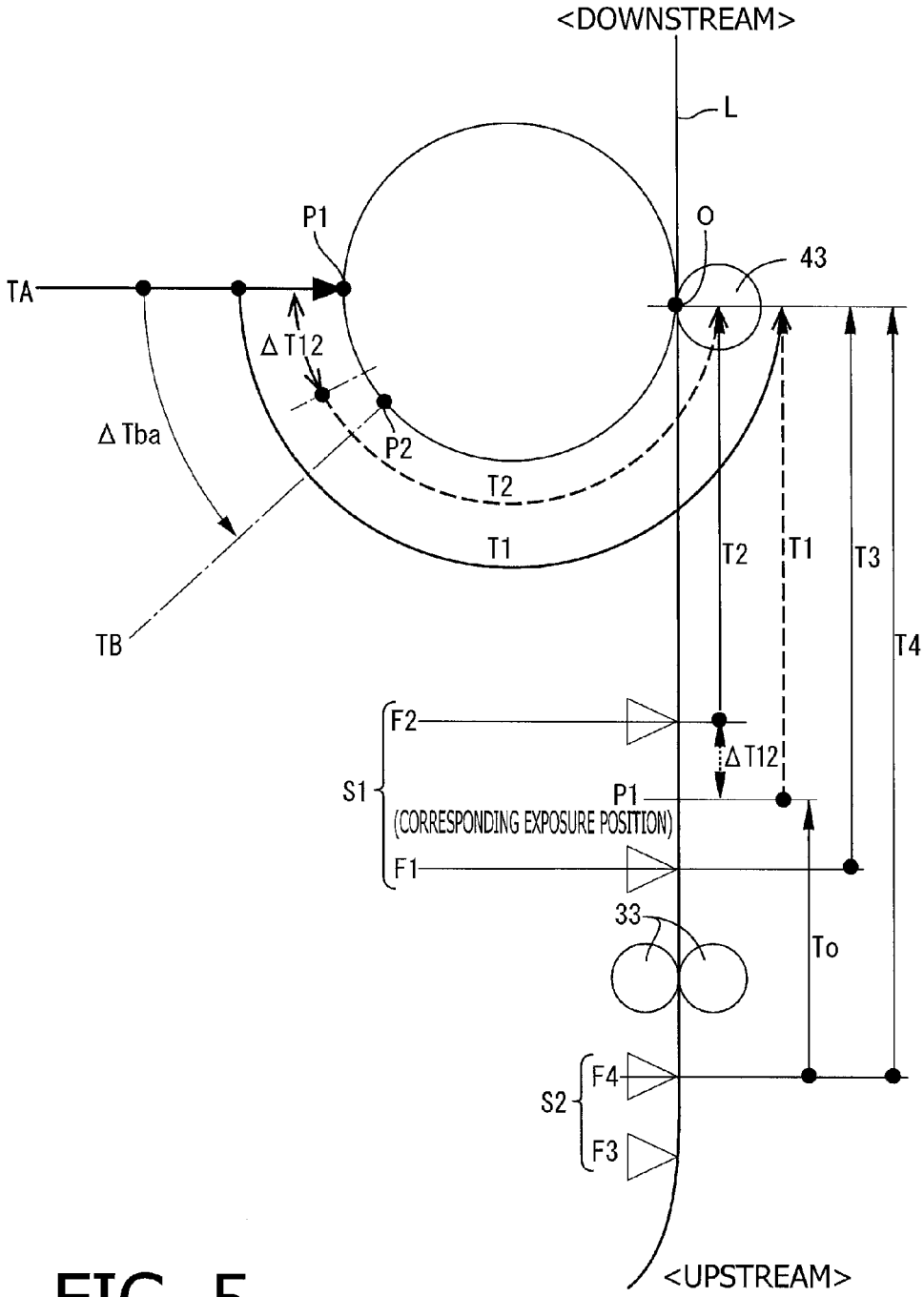

FIG. 5 is an enlarged view of a part around a photoconductive drum of the printer in the first embodiment according to one or more aspects of the present invention.

Figure 6:
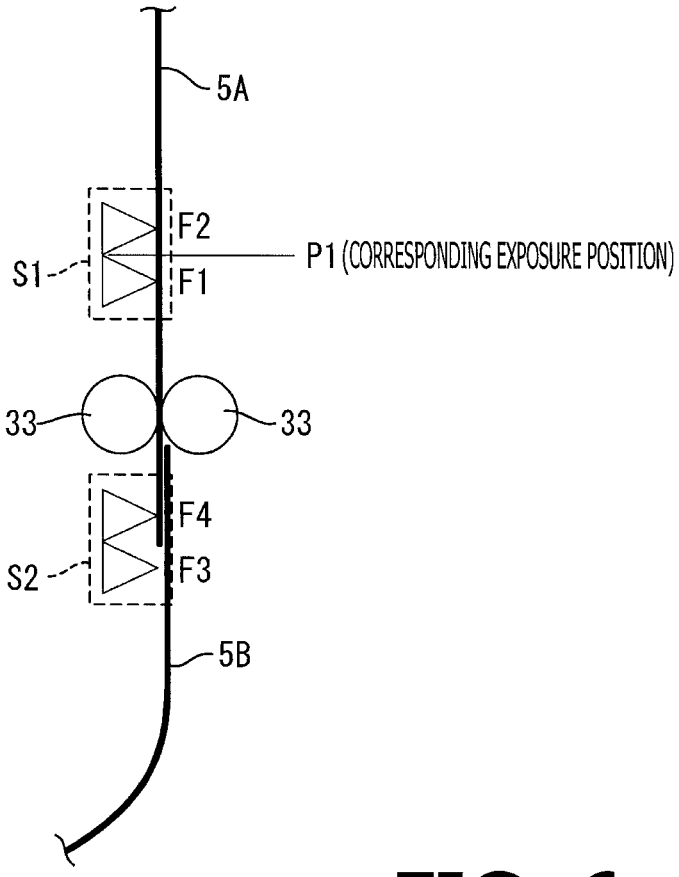

FIG. 6 is an enlarged view of a part around feeding rollers of the printer in the first embodiment according to one or more aspects of the present invention.

Figure 7:
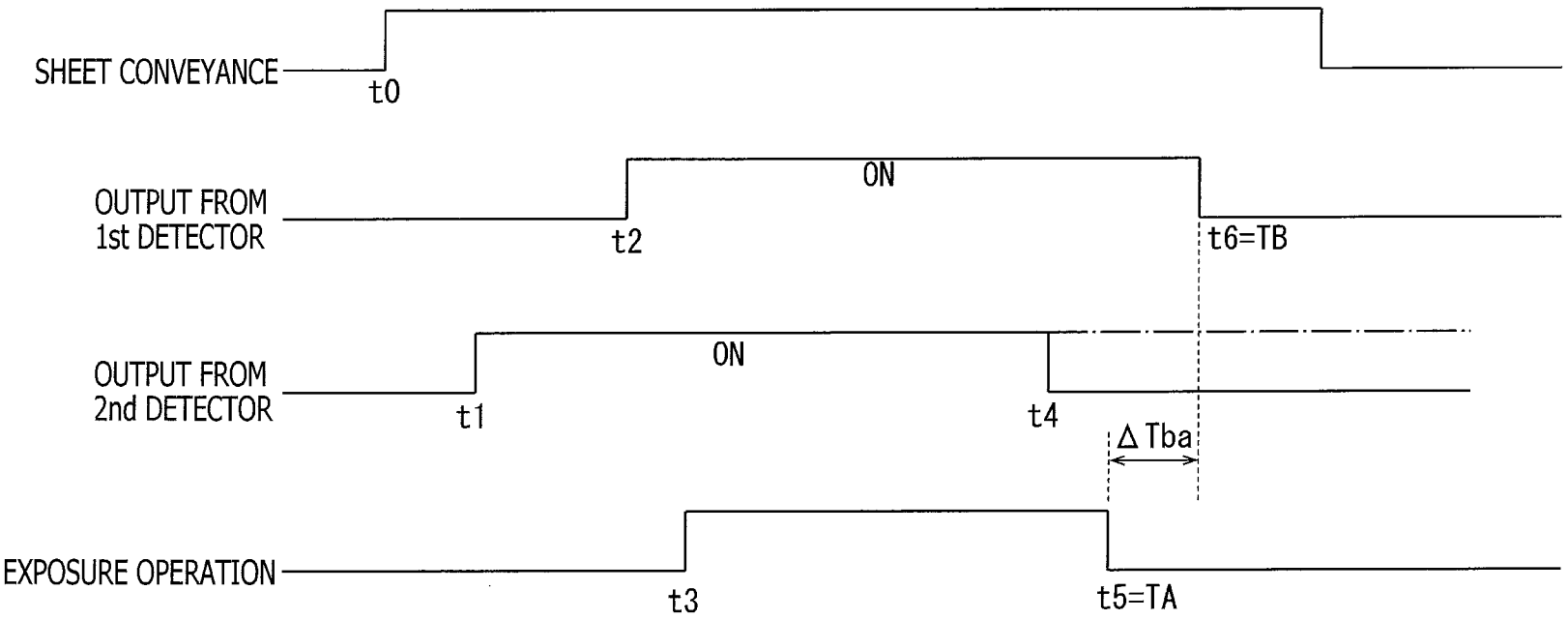

FIG. 7 is a timing chart showing a relationship between states (ON/OFF) of output signals from the first and second detectors in response to conveyance of the sheet and an exposure operation by an exposure unit in the first embodiment according to one or more aspects of the present invention.

Figure 8A:
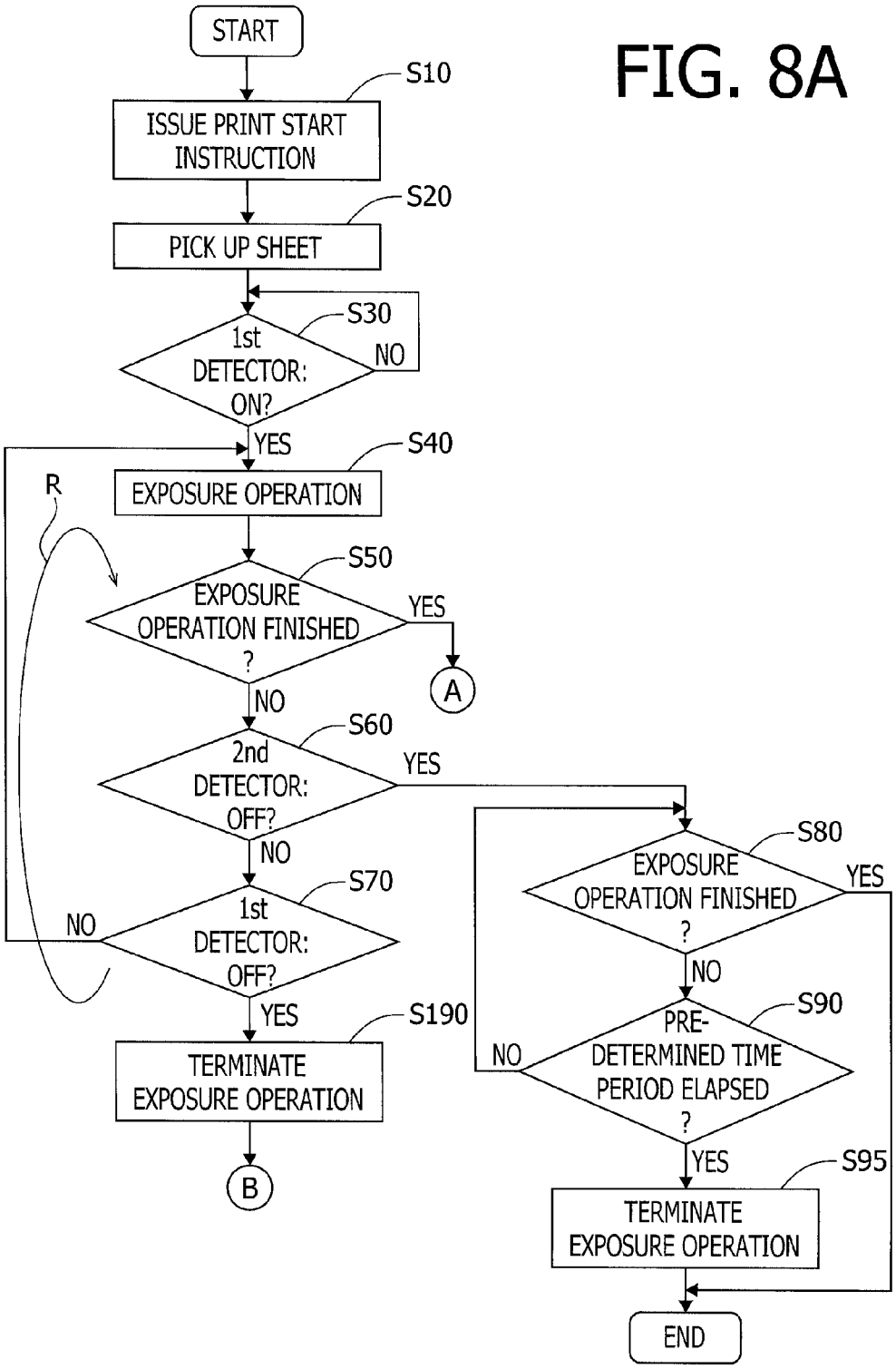
Figure 8B:
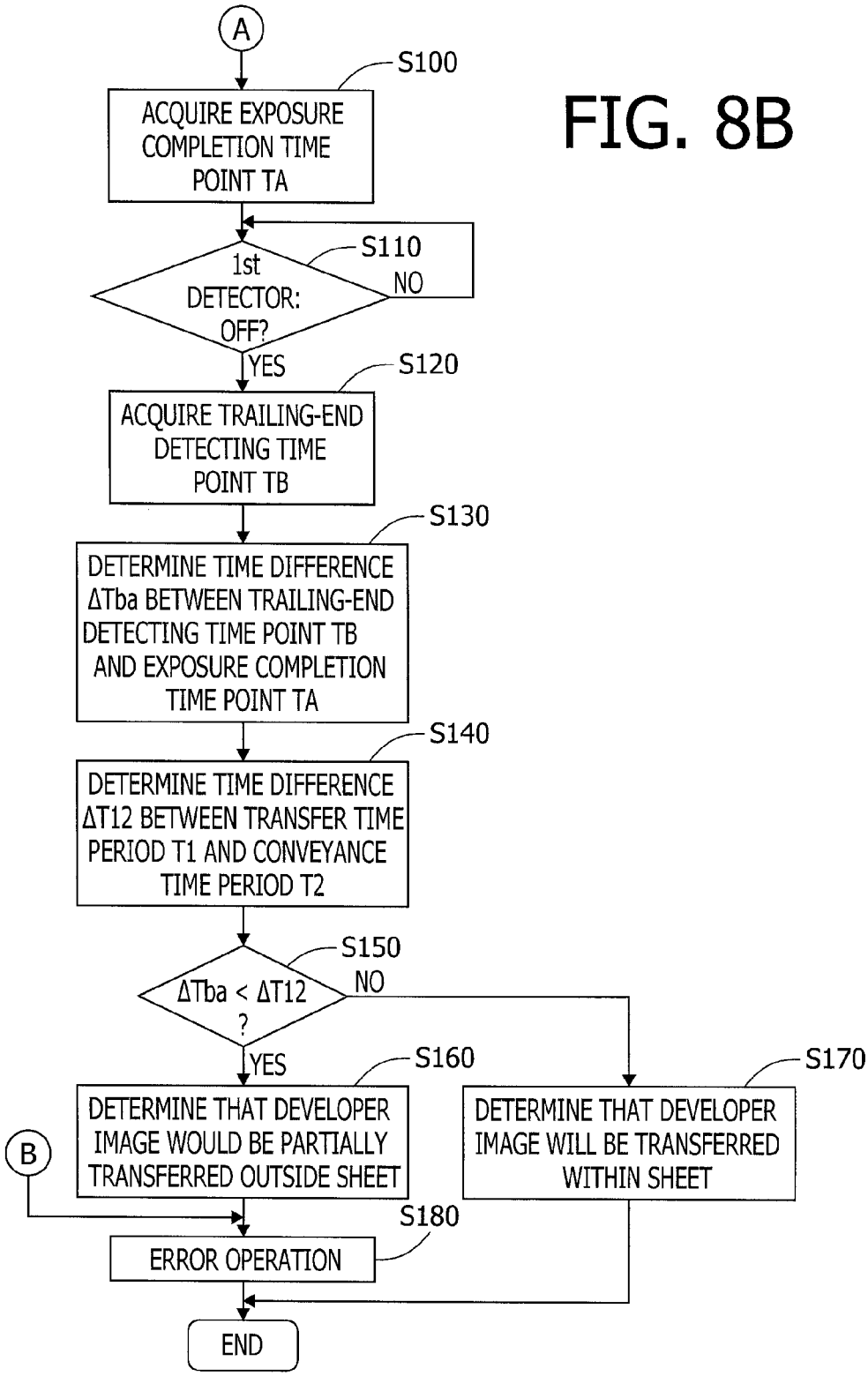

FIGS. 8A and 8B are flowcharts showing a procedure of an exposure control sequence in the first embodiment according to one or more aspects of the present invention.

Figure 9:
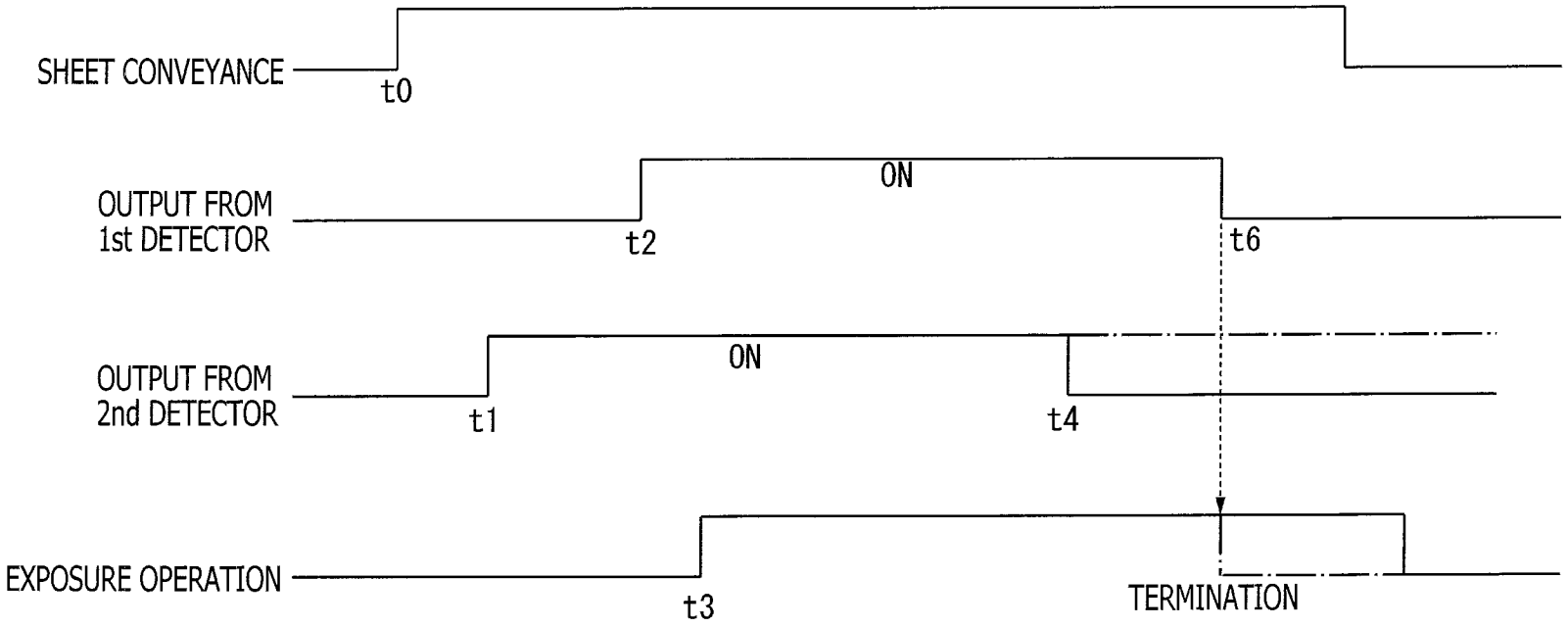

FIG. 9 is a timing chart showing another relationship between the states (ON/OFF) of the output signals from the first and second detectors in response to conveyance of the sheet and the exposure operation by the exposure unit in the first embodiment according to one or more aspects of the present invention.

Figure 10A:
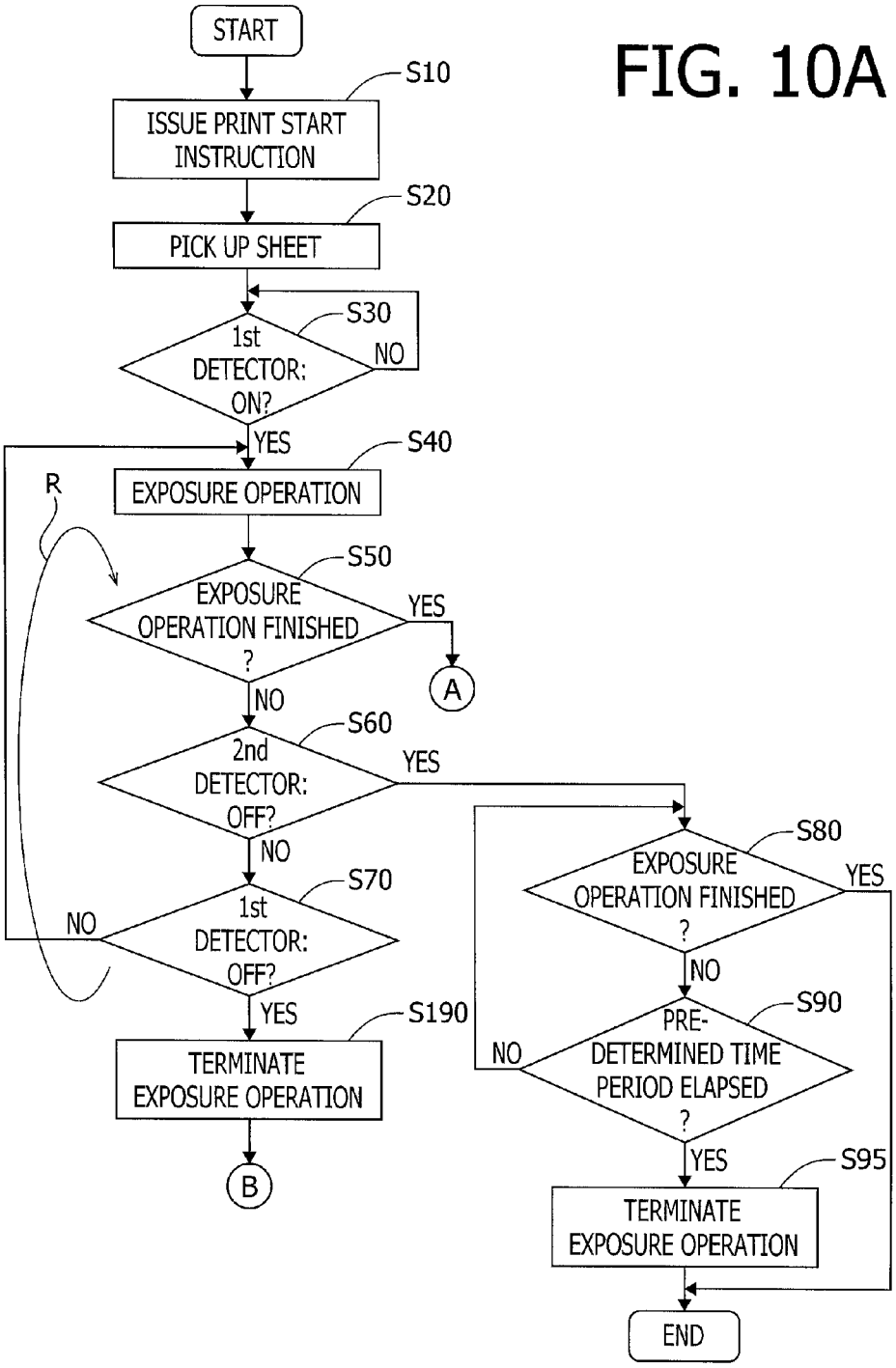
Figure 10B:
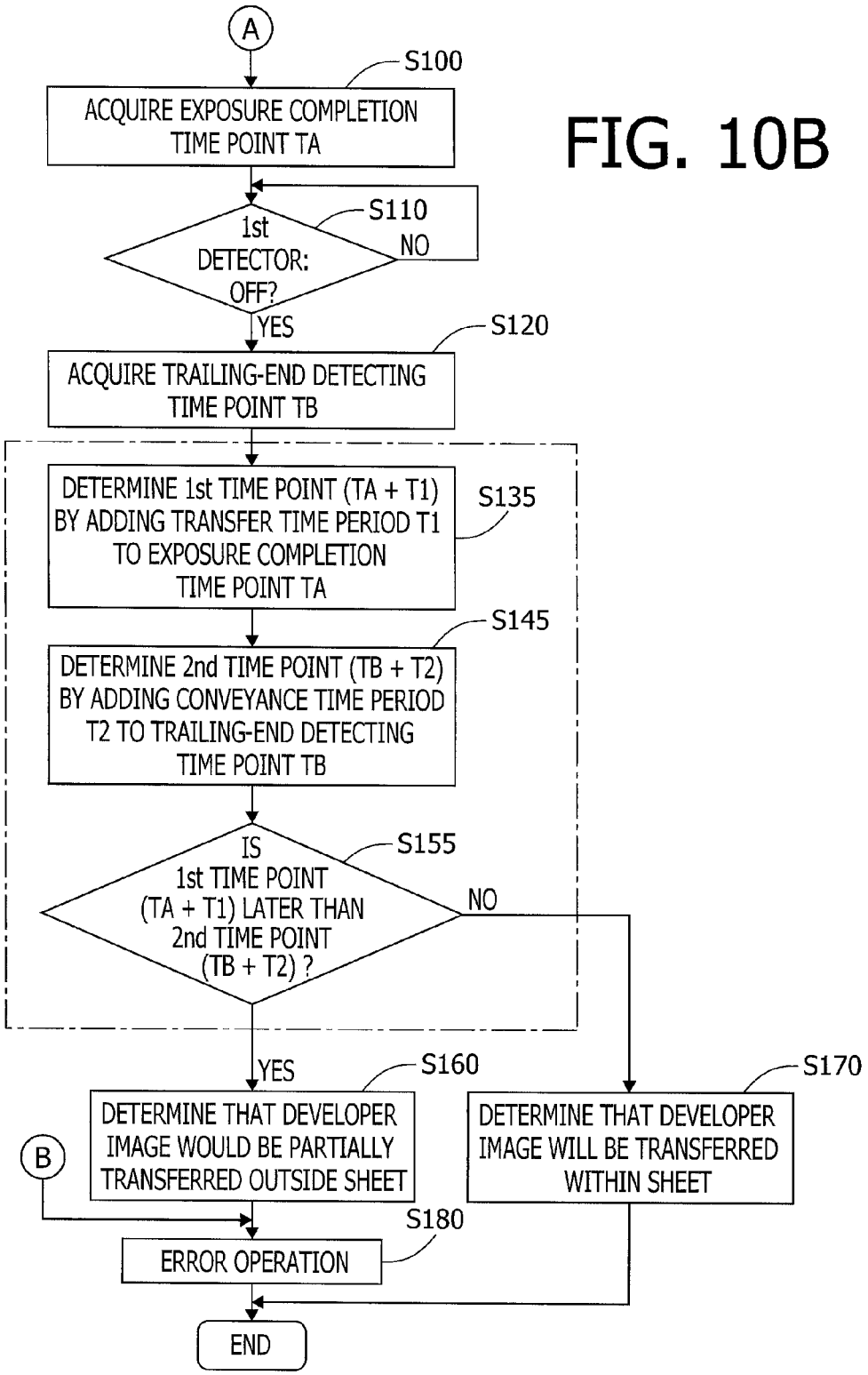

FIGS. 10A and 10B are flowcharts showing a procedure of an exposure control sequence in a second embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, embodiments according to aspects of the present invention will be described in detail with reference to the accompanying drawings.

First Embodiment

An explanation will be provided about a first embodiment according to aspects of the present invention with reference to FIGS. 1 to 9.

1. Configuration of Printer

Figure 1:
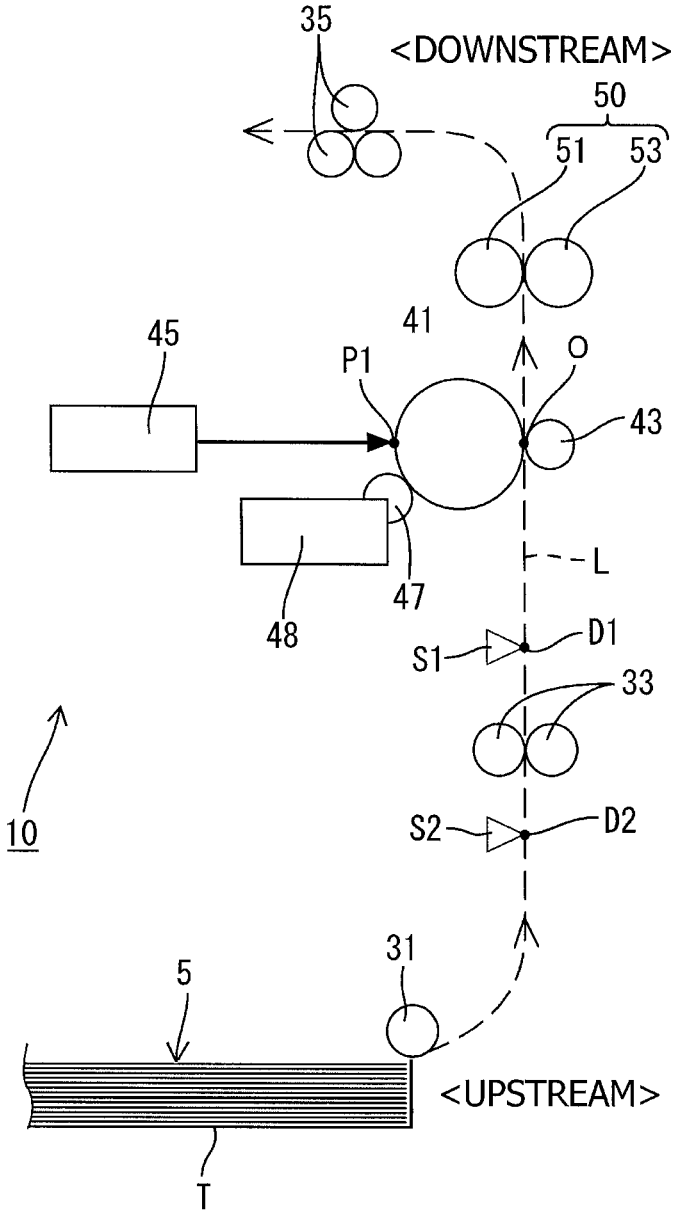
FIG. 1 is a cross-sectional side view schematically showing major parts of a printer in a first embodiment according to one or more aspects of the present invention.
Figure 2:
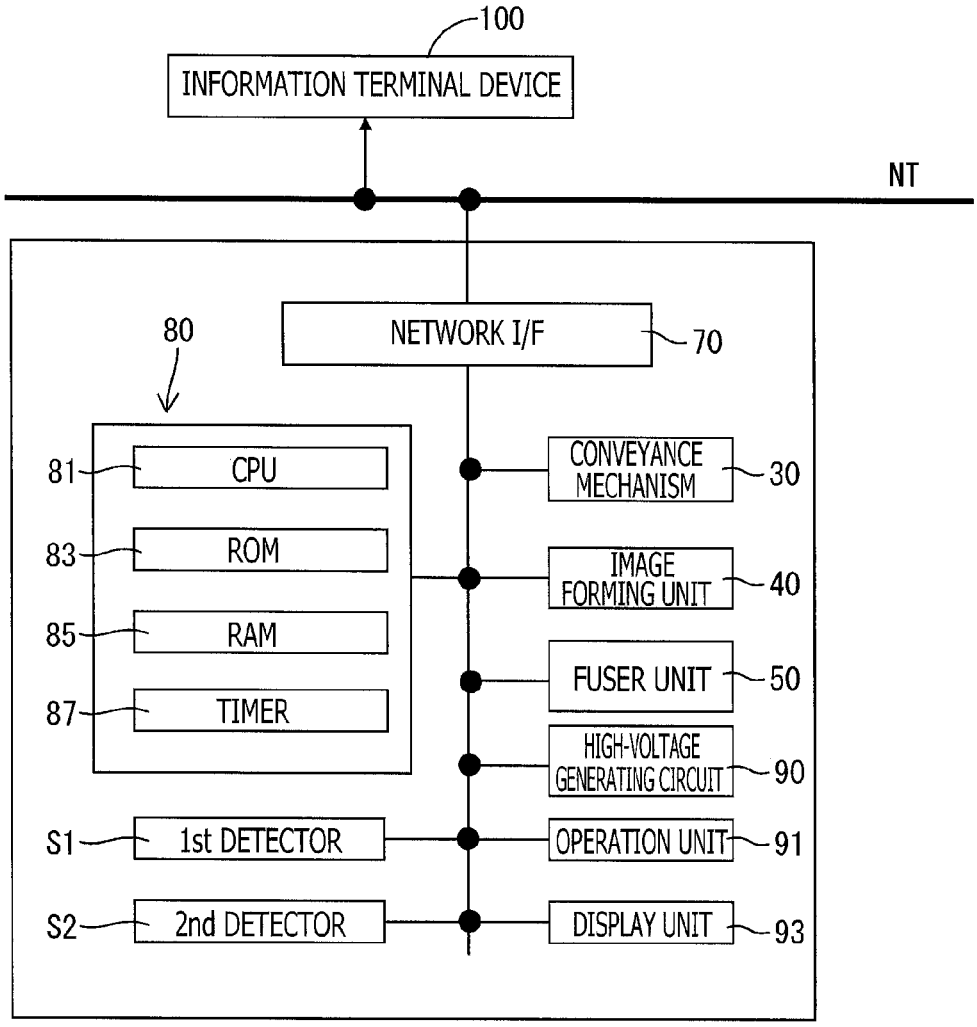
FIG. 2 is a block diagram schematically showing an electrical configuration of the printer in the first embodiment according to one or more aspects of the present invention.

Referring to FIGS. 1 and 2, a configuration of a printer 10 will be set forth. The printer 10 includes a conveyance mechanism 30, an image forming unit 40, a fuser unit 50, a first detector S1, a second detector S2, an operation unit 91, a display unit 93, a network interface 70, a controller 80, and a high-voltage generating circuit 90.

The conveyance mechanism 30 is configured to pick up sheets 5 on a sheet-by-sheet basis from a tray T disposed at a lower portion of the printer 10, and convey the sheets 5 along a conveyance path L. The conveyance mechanism 30 includes various rollers such as a pickup roller 31, feeding rollers 33, and ejection rollers 35. The pickup roller 31 is configured to pick up a sheet 5 from the tray T. The feeding rollers 33 are configured to feed the picked-up sheet 5 toward a transfer position O. The ejection rollers 35 are configured to eject the printed sheet 5 out of the printer 10.

The image forming unit 40 is configured to form, on a photoconductive drum 41, an image (a developer image) based on image data, and transfer the formed image onto the sheet 5. The image forming unit 40 includes the photoconductive drum 41, a transfer roller 43, an exposure unit 45, a charger (not shown) for charging a surface of the photoconductive drum 41, and a development roller 47.

The exposure unit 45 is configured to emit light in accordance with externally-input image data and expose the photoconductive drum 41 to the emitted light. The development roller 47 is configured to positively charge development agent supplied from a case 48, by the action of a development voltage applied to a roller shaft of the development roller 47, and to supply the positively-charge development agent onto the photoconductive drum 41. The development roller 47 is further configured to form a developer image on the photoconductive drum 41 by developing, with the development agent, an electrostatic latent image formed on the photoconductive drum 41 through the exposure by the exposure unit 45. The transfer roller 43 is configured to transfer, onto the sheet 5, the developer image formed on the photoconductive drum 41, by the action of a transfer voltage applied to a roller shaft of the transfer roller 43.

The fuser unit 50 is disposed downstream relative to the image forming unit 40 in a sheet conveyance direction in which the sheet 5 is conveyed by the conveyance mechanism 30. The fuser unit 50 includes a heating roller 51 and a pressing roller 53. The fuser unit 50 is configured to thermally fix the developer image transferred on the sheet 5 while the sheet 5 is passing between the heating roller 51 and the pressing roller 53. Then, the sheet 5 with the developer image thermally fixed thereon is ejected onto a catch tray (not shown) by the ejection rollers 35.

The operation unit 91 is provided with buttons and keys, and configured to accept, via the buttons and the keys, various user operations such as a user operation for entering an instruction to perform printing on the sheet 5. The display unit 93 is provided with a liquid crystal display (LCD) and lamps, and configured to show, via the LCD and the lamps, various setting screens and operational statuses. The network interface 70 is connected with an information terminal device 100 such as a PC or a facsimile machine via a communication line NT. The network interface 70 is configured to perform mutual data communication with the information terminal device 100. The high-voltage generating circuit 90 is configured to generate a high voltage to be applied to the charger, the development roller 47, and the transfer roller 43.

The controller 80 is configured to control the printer 10. The controller 80 includes a CPU 81, a ROM 83, a RAM 85, and a timer 87 for measuring time. The ROM 83 is configured to store various programs (such as a below-mentioned exposure control sequence) for controlling the printer 10. The RAM 85 is configured to store various data. Upon receipt of a print job from the information terminal device 100, the CPU 81 of the controller 80 performs a printing operation to electro-photographically print an image based on image data on the sheet 5. Further, the controller 80 is configured to execute, in parallel with the printing operation, a below-mentioned exposure control sequence to perform an operation of determining whether the developer image formed on the photoconductive drum 41 would be partially transferred outside the sheet 5.

2. Exposure Control

Figure 3:
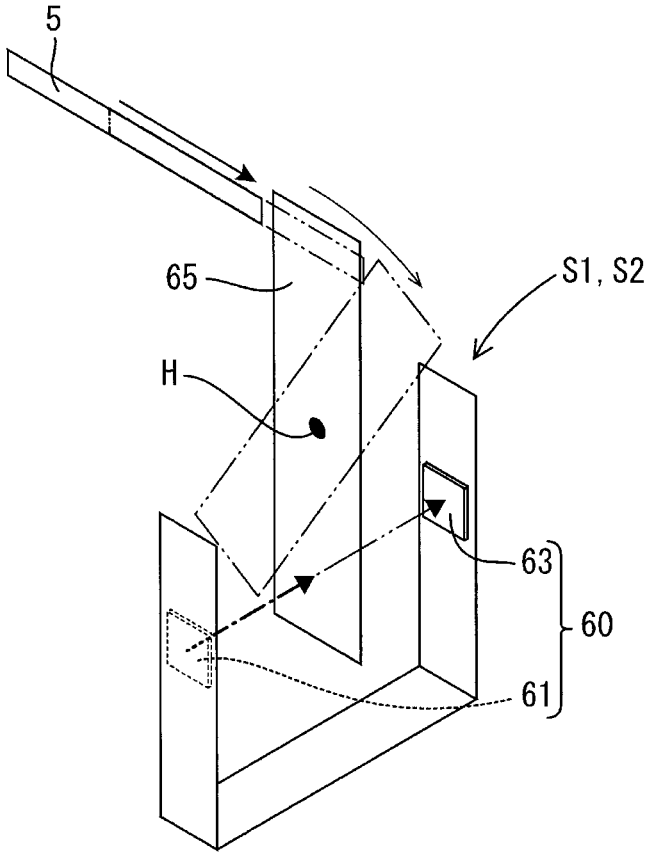
FIG. 3 is a perspective view schematically showing a configuration of a first detector and a second detector of the printer in the first embodiment according to one or more aspects of the present invention.

As shown in FIG. 1, a first detector S1 is disposed between the feeding rollers 33 and the transfer roller 43 on the conveyance path L. As shown in FIG. 3, the first detector S1 includes an optical sensor 60 and a shield plate 65. The optical sensor 60 includes a light emitting element 61 and a light receiving element opposed to each other.

The optical sensor 60 is configured to provide an "ON" output signal when light emitted by the light emitting element 61 is received by the light receiving element 63, and provide an "OFF" output signal when the light emitted by the light emitting element 61 is blocked before reaching the light receiving element 63. In the first embodiment, as the optical sensor 60, a transmission-type photoelectric sensor (a photo-interrupter) is employed in which the light emitting element 61 and the light receiving element 63 are packaged.

The shield plate 65 is supported to be rotatable around a hinge H, between the light emitting element 61 and the light receiving element 63. A distal end of the shield plate 65 protrudes into the conveyance path L. The shield plate 65 is configured to move in response to conveyance of the sheet 5. Specifically, when the shield plate 65 is not in contact with the sheet 5, the shield plate 65 is in a shielding posture in which the shield plate is oriented in a vertical direction as indicated by a solid line in FIG. 3. In the shielding posture, the shield plate 65 is placed between the light emitting element 61 and the light receiving element 63 so as to block the light from the light emitting element 61 toward the light receiving element 63. Therefore, the optical sensor 60 provides the "OFF" output signal when not detecting the sheet 5.

Meanwhile, while the shield plate 65 is in contact with the sheet 5 being conveyed on the conveyance path L, the shield plate 65 takes a light-path opening posture in which the shield plate 65 is rotated around the hinge H and is slanted with respect to the vertical direction as indicated by a long dashed double-short dashed line in FIG. 3, so as to open a light path from the light emitting element 61 to the light receiving element 63. Thereby, since the light from the light emitting element 61 is allowed to reach the light receiving element 63, the optical sensor 60 provides the "ON" output signal when detecting the sheet 5.

Thus, the output from the optical sensor 60 is switched between the "ON" output signal and the "OFF" output signal, in accordance with the movement of the shield plate 65 responsive to conveyance of the sheet 5. Therefore, it is possible to detect the sheet 5 being conveyed on the conveyance path L, based on whether the output from the optical sensor 60 is "ON" or "OFF."

Specifically, as shown in FIG. 4B, it is possible to detect a leading end of the sheet 5 passing through a leading-end detecting position F1 by detecting a moment when the output from the optical sensor 60 is switched from "ON" to "OFF." Further, as shown in FIG. 4C, it is possible to detect a trailing end of the sheet 5 passing through a trailing-end detecting position F2 by detecting a moment when the output from the optical sensor 60 is changed from "OFF" to "ON." It is noted that the same applies to the second detector S2. In addition, a speed of a rotational surface of the photoconductive drum 41 is equivalent to a conveyance speed at which the sheet 5 is conveyed on the conveyance path L. Therefore, a time period required for conveying the sheet 5 between two points on the conveyance path L corresponds to a distance between the two points on a one-to-one basis. Thus, in the following description, when a distance between two points on the conveyance path L is equal to a distance between different two points on the conveyance path L, a time period required for conveying the sheet 5 between the two points is regarded as being equal to a time period required for conveying the sheet 5 between the different two points.

The first detector S1 is used to control timing for starting an exposure operation. Specifically, the first detector S1 is configured to start the exposure operation of exposing the photoconductive drum 41 based on a moment when the leading end of the sheet 5 passes through the leading-end detecting position F1. Namely, it is possible to reduce a positional deviation between an actual position and a desired position of an image on the sheet 5, as the controller 80 determines a moment (timing) to start the exposure operation of exposing the photoconductive drum 41 based on a position where the leading end of the sheet 5 is detected.

The first detector S1 is disposed in a first position D1 on the conveyance path L (see FIG. 1). Specifically describing with reference to FIGS. 4A, 4B, 4C, and 5, the first position D1 is such a position that a conveyance time period T2 is shorter than a transfer time period T1, where the transfer time period T1 is a time period required for an arbitrary point on the surface of the photoconductive drum 41 to move to the transfer position O from an exposure position P1 where the exposure operation is performed, and the conveyance time period T2 is a time period required for movement of the trailing end of the sheet 5 from the trailing-end detecting position F2 to the transfer position O.

Further, the first position D1 is such a position that a conveyance time period T3 is longer than the transfer time period T1, where the conveyance time period T3 is a time period required for movement of the leading end of the sheet 5 from the leading-end detecting position F1 to the transfer position O.

Further, as shown in FIG. 1, the second detector S2 is disposed between the pickup roller 31 and the feeding rollers 33, on the conveyance path L. In the same manner as the first detector S1, the second detector S2 includes an optical sensor 60 and a shield plate 65, and is configured to detect the sheet 5 being conveyed on the conveyance path L based on whether the optical sensor 60 provides an "ON" output signal or an "OFF" output signal.

The second detector S2 is disposed in a second position D2 upstream relative to the first detector S1 in a conveyance direction (i.e., lower than the first detector S1 in FIG. 1). Specifically, as shown in FIGS. 4A, 4B, 4C, and 5, the second position D2 is such a position that both a leading-end detecting position F3 and a trailing-end detecting position F4 of the second detector S2 are upstream relative to a corresponding exposure position P1 on the conveyance path L in the conveyance direction in which the sheet 5 is conveyed, and that a conveyance time period T4 is longer than the transfer time period T1. It is noted that the conveyance time period T4 is a time period required for movement of the trailing end of the sheet 5 from the trailing-end detecting position F4 to the transfer position O.

The second detector S2 is used to control timing for terminating the exposure operation. Namely, the second detector S2 is configured to terminate the exposure operation of exposing the photoconductive drum 41 based on a moment when the second detector S2 detects the trailing end of the sheet 5 (see below-mentioned steps S90 and S95).

Specifically, when the exposure operation of exposing the photoconductive drum 41 is not finished by a time when a predetermined time period To elapses after the second detector S2 detects the trailing end of the sheet 5 passing through the trailing-end detecting position F4 (i.e., after the output from the second detector S2 is changed from "ON" to "OFF"), the exposure operation is terminated at that time. Thereby, it is possible to terminate the exposure operation of exposing the photoconductive drum 41 based on the image data, at a time when a size of a developer image formed on the photoconductive drum 41 exceeds a size of the sheet 5 and to prevent the developer image from being transferred outside the sheet 5. It is noted that the predetermined time period To may be a time period resulting from subtracting the transfer time period T1 from the conveyance time period T4 (see FIG. 5).

3. Detection Error of Second Detector Due to Overlap Between Two Sheets

There may be caused an undesired case where a second sheet 5B, following a first sheet 5A, is dragged out by the first sheet 5A to a midway point on the conveyance path L with a leading end of the second sheet 5B partially overlapping (a trailing end of) the first sheet 5A passing through the second detector S2 after being fed by the pickup roller 31. In such an overlapping case (see FIG. 6), even when the first sheet 5A has passed through the second detector S2, the overlapping second sheet 5B may be left in a position of the second detector S2, and thereby the optical sensor 60 of the second detector S2 may remain to provide the "ON" output signal. In this case, the second detector S2 is not allowed to detect the trailing end of the first sheet 5A, and therefore it is impossible to perform the exposure operation in conformity with a size of the sheet 5A.

4. Control for Terminating Exposure Operation Using First Detector

In view of the above problem, the printer 10 is configured to control timing for terminating the exposure operation based on an exposure completion time point TA when the exposure operation using the image data has been completed, a trailing-end detecting time point TB when the first detector S1 has detected the trailing end of the sheet 5, the transfer time period T1, and the conveyance time period T2.

Specifically, the controller 80 is configured to measure the exposure completion time point TA when the exposure using the image data is completed and the trailing-end detecting time point TB when the first detector S1 detects the trailing end of the sheet 5, and to determine a time difference ΔTba between the exposure completion time point TA and the trailing-end detecting time point TB (see FIGS. 5 and 7). Further, the controller 80 is configured to compare the determined time difference ΔTba with a time difference ΔT12 resulting from subtracting the conveyance time period T2 from the transfer time period T1.

When the determined time difference ΔTba is longer than the time difference ΔT12, as shown in FIG. 5, it means that an exposure completion point P2 on the photoconductive drum 41 is closer to the transfer position O than the trailing-end detecting position F2 at the trailing-end detecting time point TB. In this case, it is determined that the image based on the image data has a size smaller than the size of the sheet 5, and that the developer image formed on the photoconductive drum 41 will be transferred within the sheet 5 (S150: Yes, and S170).

Meanwhile, When the time difference ΔTba is shorter than the time difference ΔT12, it means that the exposure completion point P2 on the photoconductive drum 41 is farther from the transfer position O than the trailing-end detecting position F2 at the trailing-end detecting time point TB. In this case, it is determined that the image based on the image data has a size larger than the size of the sheet 5, and that the developer image formed on the photoconductive drum 41 would be partially transferred outside the sheet 5 (S150: No, and S180).

Thus, even when the second detector S2 is not allowed to detect the trailing end of the first sheet 5A, it is possible to determine whether the developer image formed on the photoconductive drum 41 would be partially transferred outside the first sheet 5A, by performing the easy calculations.

It is noted that the transfer time period T1 is determined based on a distance between the exposure position P1 and the transfer position O and a rotational speed of the photoconductive drum 41, and is previously stored on the ROM 83. Further, the conveyance time period T2 is determined based on a distance between the trailing-end detecting position F2 and the transfer position O and the conveyance speed of the sheet 5, and is previously stored on the ROM 83. In addition, the conveyance time period T3 and the conveyance time period T4 are previously stored on the RAM 83.

5. Exposure Control Sequence

Hereinafter, an explanation will be provided about an exposure control sequence to be executed by the controller 80, with reference to FIGS. 7, 8, and 9. The exposure control sequence is performed when there is a print job received from the information terminal device 100. In S10, the controller 80 issues a print start instruction to the conveyance mechanism 30, the image forming unit 40, and the fuser unit 50 of the printer 10.

Afterward, in S20, the controller 80 controls the conveyance mechanism 30 to drive the pickup roller 31, pick up a sheet 5 from the tray T, and feed the picked-up sheet 5 onto the conveyance path L (see a time point t0 in FIG. 7).

(a) When the Sheets are Normally Conveyed on a Sheet-By-Sheet Basis

After the sheet conveyance is started, the sheet 5 sequentially passes through the second detector S2 and the first detector S1. At a time point t1 when the leading end of the sheet 5 passes through the second detector S2, the output from the second detector S2 is changed from "OFF" to "ON." At a time point t2 when the leading end of the sheet 5 passes through the first detector S1, the output from the second detector S1 is changed from "OFF" to "ON."

When a first sheet 5 is fed from the tray T onto the conveyance path L, the controller 80 goes to S30, in which the controller 80 determines whether the output from the first detector S1 is "ON." During a time period from the time point t0 to the time point t2, the output from the first detector S1 is "OFF." Therefore, in S30, the controller 80 determines that the output from the first detector S1 is not "ON" (S30: No).

Then, at the time point t2 when the leading end of the first sheet 5 passes through the first detector S1, the output from the first detector S1 is changed to "ON," and the controller 80 determines in S30 that the output from the first detector S1 is "ON" (S30: Yes). Thereafter, the controller 80 goes to S40.

In S40, the controller 80 controls the exposure unit 45 to start an exposure operation of exposing the photoconductive drum 41 at a time point t3. After that, in S50, the controller 80 determines whether the exposure operation of exposing the photoconductive drum 41 based on the image data has been finished. When the exposure operation has not been finished, the controller 80 makes a negative determination in S50 (S50: No).

Afterward, the sheet 5 is conveyed downstream in the conveyance direction in parallel with the exposure operation, and the output from the second detector S2 is changed from "ON" to "OFF" at a time point t4 when the trailing end of the sheet 5 passes through the second detector S2.

When the exposure operation has not been finished at or before the time point t4, the controller 80 determines in S60 at the time point t4 that the output from the second detector S2 is "OFF" (S60: Yes), and then goes to S80. In S80, the controller 80 determines whether the exposure operation has been finished. When determining that the exposure operation has not been finished (S80: No), the controller 80 goes to S90, in which the controller 80 determines whether the predetermined time period To has elapsed from the time point t4 when the second detector S2 detected the trailing end of the sheet 5.

When determining that the predetermined time period To has not elapsed from the time point t4 when the second detector S2 detected the trailing end of the sheet 5 (S90: No), the controller 80 goes back to S80, in which the controller 80 again determines whether the exposure operation has been finished. When the image based on the image data has a size smaller than the size of the sheet 5, the exposure operation is finished before the predetermined time period To elapses from the time point t4, and the controller 80 makes an affirmative determination in S80, i.e., determines that the exposure operation has been finished (S80: Yes). In this case, the exposure operation is normally finished.

Meanwhile, when the image based on the image data has a size larger than the size of the sheet 5, the predetermined time period To elapses from the time point t4 before the exposure operation is finished. Therefore, the controller 80 makes an affirmative determination in S90 (S90: Yes) at a time when the predetermined time period To has elapsed from the time point t4, and then goes to S95. In S95, the controller 80 terminates the exposure operation. Thereby, it is possible to terminate the exposure operation of exposing the photoconductive drum 41 based on the image data, at a time when a size of a developer image formed on the photoconductive drum 41 exceeds the size of the sheet 5 and to prevent the developer image from being transferred outside the sheet 5.

(b) When Two Sheets Partially Overlap Each Other on the Conveyance Path

Meanwhile, in the overlapping case where the second sheet 5B overlaps the trailing end of the first sheet 5A passing through the second detector S2 after being fed by the pickup roller 31, even when the first sheet 5A has passed through the second detector S2, the overlapping second sheet 5B remains in a position of the second detector S2. Hence, even at or after the time point t4 when the first sheet 5A passes through the second detector S2, the second detector S2 remains to provide the "ON" output signal (see a long dashed short dashed line in FIG. 7). In this case, both the first detector S1 and the second detector S2 remain to provide the "ON" output signal, until a time point t6 when the first detector S1 detects the trailing end of the first sheet 5A.

Therefore, a process flow in this case is as follows: after starting the exposure operation in S40, the controller 80 determines in S60 that the output from the second detector S2 is "ON" (S60: No), and determines in S70 that the output from the first detector S1 is "ON" (S70: No), and repeatedly executes a loop R shown in FIG. 8A. Then, when completing the exposure operation at a time point t5, the controller 80 determines in S50 that the exposure operation has been finished (S50: Yes), and then goes to S100.

In S100, the controller 80 acquires the exposure completion time point TA. In this case, the exposure operation has been completed at the time point t5, and therefore the exposure completion time point TA is the time point t5. It is noted that the controller 80 is configured to acquire information regarding the exposure completion time point TA from the timer 87 in response to receiving from the exposure unit 45 a notification that the exposure operation has been completed.

Afterward, the controller 80 goes to S110. In S110, the controller 80 determines whether the output from the first detector S1 is "OFF." At the time point t5, the trailing end of the first sheet 5A does not reach the first detector S1. Therefore, the controller 80 determines in S110 that the output from the first detector S1 is "ON" (S110: No). After that, when the first detector S1 detects the trailing end of the first sheet 5A at the time point t6, the output from the first detector S1 is changed from "ON" to OFF." Thereby, the controller 80 determines in S110 that the output from the first detector S1 is "OFF" (S110: Yes), and then goes to S120.

In S120, the controller 80 acquires the trailing-end detecting time point TB when the first detector S1 detects the trailing end of the first sheet 5A (i.e., a time point when the output from the first detector S1 is changed from "ON" to "OFF"). In this case, since the output from the first detector S1 is switched from "ON" to "OFF" at the time point t6, the trailing-end detecting time point TB is the time point t6.

Thereafter, the controller 80 goes to S130. In S130, the controller 80 determines the time difference ΔTba between the exposure completion time point TA and the trailing-end detecting time point TB, based on the following expression (1).

$$\Delta Tba = TB - TA \tag{1}$$

where TA represents the exposure completion time point, and TB represents the trailing-end detecting time point. It is noted that, in this example, the exposure completion time point TA is the time point t5, and the trailing-end detecting time point TB is the time point t6. Therefore, the time difference ΔTba is equal to "t6−t5."

Subsequently, the controller 80 goes to S140. In S140, the controller 80 acquires the time difference ΔT12 between the transfer time period T1 and the conveyance time period T2. The transfer time period T1 and the conveyance time period T2 are previously stored on the ROM 83. Therefore, the controller 80 acquires the time difference ΔT12 by reading out the transfer time period T1 and the conveyance time period T2 from the ROM 83 and subtracting the conveyance time period T2 from the transfer time period T1 (see the following expression (2)).

$$\Delta T12 = T1 - T2 \tag{2}$$

where T1 represents the transfer time period, and T2 represents the conveyance time period.

After execution of S140, the controller 80 goes to S150. In S150, the controller 80 compares the time difference ΔTba determined in S130 with the time difference ΔT12 determined in S140 (specifically, the controller 80 determines whether the time difference ΔT12 is longer than the time difference ΔTba).

When determining that the time difference ΔTba is longer than the time difference ΔT12 (S150: No), the controller 80 goes to S170. In S170, the controller 80 determines that the developer image formed on the photoconductive drum 41 will be transferred within the sheet 5A. This is because when the time difference ΔTba is longer than the time difference ΔT12, the image based on the image data has a size smaller than the size of the sheet 5, and thus it is determined that the developer image formed on the photoconductive drum 41 will be transferred within the sheet 5A. In this case, the exposure operation is normally finished.

Meanwhile, when determining that the time difference ΔT12 is longer than the time difference ΔTba (S150: Yes), the controller 80 goes to S160. In S160, the controller 80 determines that the developer image formed on the photoconductive drum 41 would be partially transferred outside the sheet 5A. This is because when the time difference ΔT12 is longer than the time difference ΔTba, the image based on the image data has a size larger than the size of the sheet 5, and thus it is determined that the developer image formed on the photoconductive drum 41 would be partially transferred outside the sheet 5A.

Afterward, the controller 80 goes to S180, in which the controller 80 performs an error operation. The error operation may include an operation of displaying on the display unit 93 an error message (e.g., a message "the developer image would be partially transferred outside the sheet") and an operation to prevent the developer image from being partially transferred outside the sheet 5A.

The operation to prevent the developer image from being partially transferred outside the sheet 5A may include the following operation. That is, by controlling the high-voltage generating circuit 90 to apply to the transfer roller 43 a reverse transfer voltage having a polarity opposite to the transfer voltage at a time point when the trailing end of the sheet 5A reaches the transfer position O, it is possible to prevent a part that would be transferred outside the first sheet 5A, of the developer image formed on the photoconductive drum 41, from being transferred onto the transfer roller 43. Thus, it is possible to prevent the transfer roller 43 from being contaminated with development agent, and to cleanly print the second sheet 5B and following sheets 5.

After performing the error operation such as displaying the error message on the display unit 93 and applying the reverse transfer voltage to the transfer roller 43, the controller 80 terminates the process (the exposure control sequence) shown in FIGS. 8A and 8B.

Next, an explanation will be provided about when the first detector S1 detects the trailing end of the first sheet 5A before the exposure operation is finished (when the image based on the image data has a size much larger than the size of the sheet 5) in the overlapping case where the second sheet 5B overlaps the trailing end of the first sheet 5A passing through the second detector S2 after being fed by the pickup roller 31. In this case, as shown in FIG. 9, after the exposure operation is started, both the first detector S1 and the second detector S2 provide the "ON" output signal. Then, before the exposure operation is finished, the output from the first detector S1 is changed from "ON" to "OFF" at the time point t6 when the first detector S1 detects the trailing end of the first sheet 5A. Therefore, at the time point t6, the controller 80 determines in S70 that the output from the first detector S1 has been changed to "OFF" (S70: Yes), and then goes to S190.

In S190, the controller 80 terminates the exposure operation. After execution of S190, the controller 80 goes to S180, in which the controller 80 performs the error operation. When the first detector S1 detects the trailing end of the sheet 5A before the exposure operation is finished, it means that the image based on the image data has a size certainly larger than the size of the sheet 5. In such a case, when the exposure operation is continued after the first detector S1 detects the trailing end of the sheet 5A, a developer image corresponding to a continued part of the exposure operation would be certainly transferred outside the sheet 5A. Therefore, by terminating the exposure operation just at the time point t6 when the trailing end of the sheet 5A is detected, it is possible to promptly terminate a useless exposure operation on the photoconductive drum 41.

As described above, the printer 10 is configured to terminate the exposure operation on the photoconductive drum 41 based on the time point t4 when the second detector S2 detects the trailing end of the sheet 5. Therefore, it is possible to terminate the exposure operation of exposing the photoconductive drum 41 based on the image data, at the time point when the size of the developer image based on the image data exceeds the size of the sheet 5. Thus, it is possible to prevent the developer image from being transferred outside the sheet 5.

Further, the printer 10 includes the second detector S2 disposed between the pickup roller 31 and the feeding rollers 33 on the conveyance path L. In the printer 10, in the overlapping case where the second sheet 5B overlaps the trailing end of the first sheet 5A passing through the second detector S2 after being fed by the pickup roller 31, the second detector S2 may remain to provide the "ON" output signal when detecting the second sheet 5B even after the first sheet 5A has passed through the second detector S2. Namely, the second detector S2 may not normally detect the trailing end of the first sheet 5A. However, by comparing the time difference ΔTba with the time difference ΔT12, the printer 10 determines whether the developer image formed on the photoconductive drum 41 would be partially transferred outside the sheet 5A. Therefore, even though the second detector S2 does not normally detect the trailing end of the first sheet 5A, in response to determining that the developer image formed on the photoconductive drum 41 would be partially transferred outside the sheet 5A, the printer 10 performs the error operation.

Further, the first detector S1 is disposed downstream relative to the feeding rollers 33 in the conveyance direction. Therefore, the second sheet 5B, overlapping the trailing end of the first sheet 5A, comes into contact with the feeding rollers 33 and stops at that position. Accordingly, the overlapping second sheet 5B is kept from being conveyed downstream relative to the feeding rollers 33 together with the first sheet 5A. Thus, even in the aforementioned overlapping case, the first detector S1 is allowed to certainly detect the trailing end of the first sheet 5A.

Additionally, in the aforementioned overlapping case, the first detector S1 has a function of detecting the trailing end of the first sheet 5A and a function of controlling the timing to start the exposure operation. Therefore, it is possible to achieve a smaller number of components of the printer 10 than when there is a detector provided for each of the functions.

Second Embodiment

Subsequently, a second embodiment according to aspects of the present invention will be described with reference to FIGS. 10A and 10B. In the first embodiment, the controller 80 is configured to determine whether the developer image formed on the photoconductive drum 41 would be partially transferred outside the sheet 5, by comparing the time difference ΔTba resulting subtracting the exposure completion time point TA from the trailing-end detecting time point TB with the time difference ΔT12 resulting from subtracting the conveyance time period T2 from the transfer time period T1.

In the second embodiment, the controller 80 is configured to compare a first time point (TA+T1) resulting from adding the transfer time period T1 to the exposure completion time point TA with a second time point (TB+T2) resulting from adding the conveyance time period T2 to the trailing-end detecting time point TB. Specifically, when the first time point (TA+T1) is earlier than the second time point (TB+T2) (S155: No), the controller 80 determines that the developer image formed on the photoconductive drum 41 will be transferred within the sheet 5 (S170). This is because when the first time point (TA+T1) is earlier than the second time point (TB+T2), the exposure completion point P2 on the photoconductive drum 41 reaches the transfer position O before the trailing end of the sheet 5 reaches the transfer position O.

Meanwhile, when the first time point (TA+T1) is later than the second time point (TB+T2) (S155: Yes), the controller 80 determines that the developer image formed on the photoconductive drum 41 would be partially transferred outside the sheet 5 (S160). This is because when the first time point (TA+T1) is later than the second time point (TB+T2), the exposure completion point P2 on the photoconductive drum 41 reaches the transfer position O after the trailing end of the sheet 5 reaches the transfer position O.

It is noted that an exposure control sequence of the second embodiment is different from the exposure control sequence of the first embodiment in the above determining method, i.e., steps S135 to S155 surrounded with a long dashed short dashed line in FIG. 10B. More specifically describing the differences, in S135, the controller 80 determines the first time point (TA+T1) by adding the transfer time period T1 to the exposure completion time point TA. In the subsequent step S145, the controller 80 determines the second time point (TB+T2) by adding the conveyance time period T2 to the trailing-end detecting time point TB. Then, in S155, the controller 80 determines whether the first time point (TA+T1) is later than the second time point (TB+T2), so as to determine whether the developer image formed on the photoconductive drum 41 would be partially transferred outside the sheet 5.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein.

[Modifications]

For example, the following modifications are possible. It is noted that, in the following modifications, explanations about the same configurations as exemplified in the aforementioned embodiment will be omitted.

In the aforementioned embodiments, the controller 80 includes the single CPU 81, the ROM 83, and the RAM 85. However, the controller 80 may include a plurality of CPUs 81. Alternatively, the controller 80 may include a combination of a CPU 81 and one or more circuits (such as application specific integrated circuits), or may include only one or more circuits instead of the CPU 81.

In the aforementioned first embodiment, the operation of controlling the high-voltage generating circuit 90 to apply the reverse transfer voltage to the transfer roller 43 is exemplified as an operation to prevent the developer image from being transferred outside the sheet 5A. Instead of this, for instance, in order to prevent development agent from being supplied onto the photoconductive drum 41, the controller 80 may control the high-voltage generating circuit 90 to stop applying the transfer voltage to the transfer roller 43 at a time point when the trailing end of the sheet 5A reaches the transfer position O. Thereby, it is possible to prevent development agent from being supplied onto the photoconductive drum 41, and to inevitably make it hard for the developer image to be transferred outside the sheet 5A.

What is claimed is:

1. An image forming apparatus comprising:

a photoconductive body;

an exposure unit configured to perform, for an exposure position on the photoconductive body, an exposure operation of exposing the photoconductive body using image data and forming on the photoconductive body an electrostatic latent image based on the image data;

a development unit configured to develop with development agent the electrostatic latent image formed on the photoconductive body and form a developer image on the photoconductive body;

a transfer unit configured to transfer the developer image from the photoconductive body onto the sheet, in a transfer position where the transfer unit faces the photoconductive body across the sheet;

a feeding unit configured to feed the sheet in a conveyance direction on a conveyance path, toward the transfer position;

a detector configured to detect the sheet on the conveyance path and disposed in a predetermined position on the conveyance path, the predetermined position being such a position that a conveyance time period required for a trailing end of the sheet to move to the transfer position since the detector detects the trailing end of the sheet is shorter than a transfer time period required for an arbitrary point on the photoconductive body to move from the exposure position for exposing the photoconductive body to the transfer position for transferring the developer image onto the sheet; and a controller configured to perform:

an acquiring operation of acquiring an exposure completion time point when the exposure operation using the image data has been completed and a trailing-end detecting time point when the detector has detected the trailing end of the sheet; and a determining operation of determining whether the developer image would be transferred outside the sheet, based on the exposure completion time point and the trailing-end detecting time point acquired in the acquiring operation, the transfer time period, and the conveyance time period, wherein the controller is further configured to, in the determining operation:

determine whether a first time difference resulting from subtracting the exposure completion time point from the trailing-end detecting time point is shorter than a second time difference resulting from subtracting the conveyance time period from the transfer time period; and when determining that the first time difference is shorter than the second time difference, determine that the developer image would be transferred outside the sheet.

2. The image forming apparatus according to claim 1, wherein the controller is further configured to, in the determining operation:

determine whether a first time point resulting from adding the transfer time period to the exposure completion time point is later than a second time point resulting from adding the conveyance time period to the trailing-end detecting time point; and when determining that the first time point is later than the second time point, determine that the developer image would be transferred outside the sheet.

3. The image forming apparatus according to claim 1, wherein the controller is further configured to perform an error operation when determining that the developer image would be transferred outside the sheet.

4. The image forming apparatus according to claim 3, wherein the controller is further configured to prevent the developer image from being transferred outside the sheet, in the error operation.

5. The image forming apparatus according to claim 1, further comprising a second detector configured to detect the sheet on the conveyance path and disposed in a second position upstream relative to the predetermined position in the conveyance direction on the conveyance path, the second position being such a position that a second conveyance time period required for the trailing end of the sheet to move to the transfer position since the second detector detects the trailing end of the sheet is longer than the transfer time period, wherein the controller is further configured to perform:

an exposure terminating operation of controlling the exposure unit to terminate the exposure operation, in response to the second detector detecting the trailing end of the sheet;

a second determining operation of determining whether the exposure operation using the image data has been finished while the second detector is detecting existence of the sheet; and perform the acquiring operation and the determining operation when determining in the second determining operation that the exposure operation using the image data has been finished while the second detector is detecting existence of the sheet.

6. The image forming apparatus according to claim 5, wherein the controller is further configured to perform the exposure terminating operation of controlling the exposure unit to terminate the exposure operation, in response to the detector detecting the trailing end of the sheet during the exposure operation using the image data.

7. The image forming apparatus according to claim 5, further comprising a sheet supply unit configured to supply the sheet to the feeding unit, wherein the second position is located between the sheet supply unit and the feeding unit on the conveyance path.

8. The image forming apparatus according to claim 1, wherein the controller is further configured to control the exposure unit to start the exposure operation in response to the detector detecting a leading end of the sheet.

9. The image forming apparatus according to claim 8, wherein the detector comprises:

an optical sensor; and a movable member configured to, in response to conveyance of the sheet move so as to change a state of an output signal from the optical sensor to a different state, and wherein the predetermined position of the detector is such a position that a time period between a time point when the detector detects the leading end of the sheet based on the change of the state of the signal output from the optical sensor and a time point when the leading end of the sheet reaches the transfer position is longer than the transfer time period.

10. The image forming apparatus according to claim 1, wherein the predetermined position of the detector is located downstream relative to the feeding unit in the conveyance direction.

11. An image forming apparatus configured to electrophotographically form an image on a sheet, comprising:

a photoconductive body;

an exposure unit configured to perform, for an exposure position on the photoconductive body, an exposure operation of exposing the photoconductive body and forming an electrostatic latent image on the photoconductive body;

a development unit configured to develop with development agent the electrostatic latent image formed on the photoconductive body and form a developer image on the photoconductive body;

a transfer unit configured to transfer the developer image from the photoconductive body onto the sheet, in a transfer position where the transfer unit faces the photoconductive body across the sheet;

a conveyance mechanism configured to convey the sheet in a conveyance direction via the transfer position on a conveyance path, the conveyance mechanism comprising:

a first detector configured to output a first signal when the sheet is in a first position on the conveyance path, and output a second signal when the sheet is not in the first position on the conveyance path;

a second detector configured to output a first-state signal when the sheet is in a second position upstream relative to the first position in the conveyance direction on the conveyance path, and output a second-state signal when the sheet is not in the second position on the conveyance path; and a feeding roller disposed between the first detector and the second detector on the conveyance path and configured to feed the sheet in the conveyance direction from the second detector toward the first detector; and a controller configured to:

control the exposure unit to start the exposure operation in response to the second signal output from the first detector changing into the first signal; and control the exposure unit to terminate the exposure operation in response to the first signal output from the first detector changing into the second signal while the second detector is outputting the first-state signal.

12. The image forming apparatus according to claim 11, configured to satisfy a relational expression "$L1<L0<L2$," where L0 represents a distance between the exposure position and the transfer position on the photoconductive body, L1 represents a distance between the first position and the transfer position on the conveyance path, and L2 represents a distance between the second position and the transfer position on the conveyance path.

13. The image forming apparatus according to claim 12, wherein the conveyance mechanism further comprises a sheet supply mechanism configured to supply the sheet onto the conveyance path and feed the supplied sheet toward the feeding roller via the second position.

* * * * *